US009833116B2

(12) United States Patent
Huang et al.

(10) Patent No.: US 9,833,116 B2
(45) Date of Patent: Dec. 5, 2017

(54) METHOD AND APPARATUS FOR PROVIDING MULTIPLE MODES OF CLEANING ON A SMART ROBOTIC CLEANER

(71) Applicant: Shenzhen BONA Robot Technology Co., Ltd., Shenzhen (CN)

(72) Inventors: Jianmin Huang, Shenzhen (CN); Yibo Cao, Shenzhen (CN)

(73) Assignee: Shenzhen BONA Robot Technology Co., Ltd., Shenzhen (CN)

( * ) Notice: Subject to any disclaimer, the term of this patent is extended or adjusted under 35 U.S.C. 154(b) by 226 days.

(21) Appl. No.: 14/735,935

(22) Filed: Jun. 10, 2015

(65) Prior Publication Data

US 2016/0051108 A1 Feb. 25, 2016

(30) Foreign Application Priority Data

Aug. 21, 2014 (CN) ..... 2014 1 0415039

(51) Int. Cl.
*A47L 9/28* (2006.01)
*A47L 9/04* (2006.01)

(52) U.S. Cl.
CPC ..... *A47L 9/2857* (2013.01); *A47L 9/0411* (2013.01); *A47L 9/0477* (2013.01); *A47L 9/0488* (2013.01); *A47L 9/2842* (2013.01); *A47L 9/2847* (2013.01); *A47L 2201/06* (2013.01)

(58) Field of Classification Search
CPC .. A47L 2201/06; A47L 9/0488; A47L 9/0411; A47L 9/0477; A47L 9/2842; A47L 9/2847; A47L 9/2857
USPC ..... 15/347; 134/18
See application file for complete search history.

(56) References Cited

U.S. PATENT DOCUMENTS 6,611,738 B2 * 8/2003 Ruffner ..... A01B 69/008 318/581
6,741,054 B2 * 5/2004 Koselka ..... A47L 11/24 15/3
8,483,881 B2 * 7/2013 Ermakov ..... A47L 5/225 382/153
8,898,844 B1 * 12/2014 Dooley ..... A47L 11/10 15/319
2006/0288519 A1 * 12/2006 Jaworski ..... A47L 11/28 15/340.1
2007/0061043 A1 * 3/2007 Ermakov ..... A47L 5/225 700/263
2008/0184518 A1 * 8/2008 Taylor ..... A47L 9/009 15/319

(Continued)

*Primary Examiner* — Marc Carlson
(74) *Attorney, Agent, or Firm* — JCIPRNET

(57) ABSTRACT

Methods and apparatuses for providing multiple modes of cleaning on a smart robotic cleaner are disclosed. A cleaning mode of rolling brush sweeping and a cleaning mode of vacuuming are provided on the smart robotic cleaner. When different cleaning devices are replaced on the body of the smart robotic cleaner, an electronic control unit in the body may control the smart robotic cleaner to switch between the cleaning modes automatically. A mounting position may be provided in the smart robotic cleaner. A rolling brush assembly and a suction inlet assembly may be detachably mounted on the mounting position, and the rolling brush assembly and the suction inlet assembly may be replaced with each other at the mounting position.

9 Claims, 7 Drawing Sheets

(56) References Cited

U.S. PATENT DOCUMENTS

2011/0277269 A1* 11/2011 Kim ..... A47L 7/02
15/349

* cited by examiner

METHOD AND APPARATUS FOR PROVIDING MULTIPLE MODES OF CLEANING ON A SMART ROBOTIC CLEANER

TECHNICAL FIELD

The present application relates to the field of cleaning devices, more particularly to a method and an apparatus for providing multiple modes of cleaning on a smart robotic cleaner.

BACKGROUND

Smart robotic cleaners may usually suck up dust or collect garbage from the floor to be cleaned, and furthermore, they may move within a certain range automatically without a user's manual instruction. This type of smart robotic cleaners is generally equipped with an intelligent electronic control unit, multiple sensors for detecting and actuators for moving. Sensors could detect obstacles or dirt, and provide feedback to the intelligent control unit. The intelligent control unit issues commands of actions to the actuators according to the detected data. Thus, smart robotic cleaners could clean the areas to be cleaned and change their moving directions automatically at the same time.

However, the current smart robotic cleaners generally have only one working mode, e.g., either sweeping mode or vacuuming mode. Those two working modes are typically not integrated in one robotic cleaner, and hence the applicable scope is too narrow.

SUMMARY

The present application discloses a method and an apparatus for providing multiple modes of cleaning on a smart robotic cleaner, which integrates both sweeping mode and vacuuming mode from which users may select on the smart robotic cleaner, and thus there are more ways of cleaning and the applicable scope is more extensive.

In order to solve the above technical problems, the present application discloses a method for providing multiple ways of cleaning on a smart robotic cleaner employs a technical solution as follows:

A method for providing multiple ways of cleaning on a smart robotic cleaner, integrating two cleaning modes of brush sweeping and vacuuming on one smart robotic cleaner; an electronic control unit of the smart robotic cleaner switching cleaning modes automatically according to the different cleaning devices replaced on the smart robotic cleaner. That is, as long as a user replaces two different cleaning devices on the body of a smart robotic cleaner, the electronic control unit in the body may control the smart robotic cleaner to switch between the cleaning modes automatically; thus, the two cleaning modes may be switched based on a user's need, achieving a multi-purpose machine. There are more ways of cleaning, and the applicable scope is more extensive.

Further, when a rolling brush assembly is mounted on the smart robotic cleaner, the smart robotic cleaner is switched to a cleaning mode of rolling brush sweeping by the electronic control unit; after the smart robotic cleaner is started, a rolling brush of the rolling brush assembly rotates and sweeps garbage around the smart robotic cleaner, and dust is drawn into a dust box of the smart robotic cleaner by the suction of a centrifugal fan. Therefore, the smart robotic cleaner could sweep floors efficiently under the co-work of a rolling brush and a centrifugal fan.

Further, when a suction inlet assembly is mounted on the smart robotic cleaner, the smart robotic cleaner is switched to a cleaning mode of vacuuming by the electronic control unit; after the smart robotic cleaner is started, a centrifugal fan rotates at a high speed, and a high speed airflow generated thereof causes pressure difference between the inside of an air duct system and the external atmospheric pressure; certain suction is generated in the vicinity of a suction inlet of the suction inlet assembly, and garbage is drawn into the dust box of the smart robotic cleaner. Therefore, the suction inlet may vacuum efficiently under the high speed working of the centrifugal fan.

In order to solve the above technical problems, the present application discloses an apparatus for providing multiple ways of cleaning on a smart robotic cleaner employs a technical solution as follows:

An apparatus for providing multiple ways of cleaning on a smart robotic cleaner comprises: a body being able to move on the ground and an electronic control unit provided in the body; an air duct is formed and an air inlet, an air outlet, a dust box assembly and a ventilation device are provided in the body; the air inlet is connected to the air outlet through the air duct; the air duct flows through the dust box assembly; the ventilation device is arranged on the air duct and could draw the air in the air duct to the air outlet; a mounting position is provided at the bottom of the body; a rolling brush assembly and a suction inlet assembly could be detachably mounted on the mounting position; the rolling brush assembly and the suction inlet assembly could be replaced with each other at the mounting position; and the air inlet is provided on the mounting position and corresponds to the rolling brush assembly or the suction inlet assembly.

Since the rolling brush assembly and the suction inlet assembly could be detachably mounted on the mounting position, and the rolling brush assembly and the suction inlet assembly may be replaced with each other at the mounting position, users may mount the rolling brush assembly or the suction inlet assembly on the smart robotic cleaner according to the actual conditions during the process of cleaning floors, achieving a multi-purpose machine. When the ventilation device starts to work, an air duct in the body could enter the state of negative pressure, and thus the air outside may come into the body through the air inlet and flow through the dust box assembly along the air duct in the body; finally, the air is drawn to the air outlet by the ventilation device and flows out of the body, forming an airflow in the body. Since the air inlet is arranged on the mounting position and corresponds to the rolling brush assembly or the suction inlet assembly, when the rolling brush assembly is mounted on the body, wastes such as dust and garbage are drawn to the air inlet along with the airflow by the time the rolling brush assembly sweeps the floor, and go into the dust box assembly along the air duct and are collected in the dust box of the dust box assembly finally. In the same way, when the suction inlet assembly is mounted on the body, wastes such as garbage and dust located below the suction inlet assembly could be drawn into the air inlet by the suction inlet assembly along with the airflow as the robotic cleaner moves, and go into the dust box assembly along the air duct and are collected in the dust box of the dust box assembly finally.

Therefore, a mounting position is arranged on a smart robotic cleaner in the apparatus of the present disclosure, a rolling brush assembly and a suction inlet assembly could be detachably mounted on the mounting position, and the rolling brush assembly and the suction inlet assembly could be replaced with each other at the mounting position. Thus users may mount a rolling brush assembly or a suction inlet assembly on the smart robotic cleaner according to the actual conditions during the process of cleaning floors, so that the setting of two cleaning modes of rolling brush sweeping and vacuuming may be implemented on the smart robotic cleaner, achieving a multi-purpose machine. There are more ways of cleaning, and the applicable scope is more extensive.

Further, a switch electrically connected to the electronic control unit is provided on the mounting position, and the electronic control unit could switch between different cleaning modes by opening or closing the switch. In particular, when the rolling brush assembly or the suction inlet assembly is mounted on the mounting position, the rolling brush assembly or the suction inlet assembly could enable or disable the switch, so that the body may switch between a cleaning mode of rolling brush sweeping or a cleaning mode of vacuuming; in the cleaning mode of rolling brush sweeping, the rolling brush assembly works; and in the cleaning mode of vacuuming, the suction inlet assembly works. For example, when the rolling brush assembly is mounted on the mounting position of the body, the switch issues a trigger signal to the electronic control unit because the rolling brush assembly abuts and enables the switch, and the electronic control unit could start a motor connected to the rolling brush in order to drive the rolling brush assembly; when the rolling brush assembly is removed from the mounting position and the suction inlet assembly is mounted, the switch is disabled and is in a disconnected state, and the motor connected to the rolling brush before may not be started, so that the robotic cleaner is able to switch between the two cleaning modes and it is more convenient to use.

Further, the rolling brush assembly comprises a rolling brush holder detachably mounted on the mounting position and a rolling brush pivotally connected to the rolling brush holder; the pivot axis of the rolling brush is set horizontally, the air inlet corresponds to the rolling brush, and the rolling brush could sweep garbage into the body as it rotates.

Further, the suction inlet assembly comprises a suction inlet holder detachably mounted on the mounting position and a suction inlet formed on the suction inlet holder, the air inlet docks with the suction inlet, and the suction inlet could draw the garbage in the vicinity of the suction inlet into the body in the mode of vacuuming.

Further, the dust box assembly in the body comprises a coarse filter and a fine filter, and an airflow in the air duct flows through the coarse filter and the fine filter in turn. Therefore, waste such as dust of different volume could be collected in the dust box separately, which facilitates the separation of the garbage later.

Further, the ventilation device comprises a centrifugal fan, and the rotating speed of the centrifugal fan may vary in accordance with the different cleaning modes of the body. Therefore, the speed of the centrifugal fan could be changed depending on the demands of different cleaning modes, in order to control the fan speed reasonably and save energy.

Optionally, several motors are provided in the body, and the air duct passes through the motors; as a result, the airflow in the air duct could flow through the motors and cool the motors effectively which dissipate heat.

Optionally, a semi-closed baffle is arranged on the bottom of the suction inlet holder, the suction inlet is located within the semi-closed range of the semi-closed baffle, and a sweeping brush could sweep garbage into the semi-closed range of the semi-closed baffle as it rotates. As a result, with the block of the semi-closed baffle, waste such as garbage and dust could accumulate more at the suction inlet, and the contact area between the suction inlet and the air outside becomes increasingly smaller as the garbage and dust accumulate, which makes the negative pressure of the air duct in the body rise within a period of time and further makes the suction at the suction inlet become gradually increasing; therefore, it is possible to increase the driving force of the airflow in the air duct efficiently and improve the effect of robotic cleaner significantly.

The advantages of the present application include:

A cleaning mode of rolling brush sweeping and a cleaning mode of vacuuming are provided on a smart robotic cleaner in the method of the present disclosure; as long as a user replaces two different cleaning devices on the body of the smart robotic cleaner, the electronic control unit in the body may control the smart robotic cleaner to switch between the cleaning modes automatically; thus, the two cleaning modes may be switched based on a user's need, achieving a multi-purpose machine. There are more ways of cleaning, and the applicable scope is more extensive.

A mounting position is provided on a smart robotic cleaner in the apparatus of the present disclosure, a rolling brush assembly and a suction inlet assembly could be detachably mounted on the mounting position, and the rolling brush assembly and the suction inlet assembly could be replaced with each other at the mounting position. As such, users may mount a rolling brush assembly or a suction inlet assembly on the smart robotic cleaner according to the actual conditions during the process of cleaning floors, so that the setting of two cleaning modes of rolling brush sweeping and vacuuming could be implemented on the smart robotic cleaner, achieving a multi-purpose machine. There are more ways of cleaning, and the applicable scope is more extensive.

DETAILED DESCRIPTION

Figure 1:
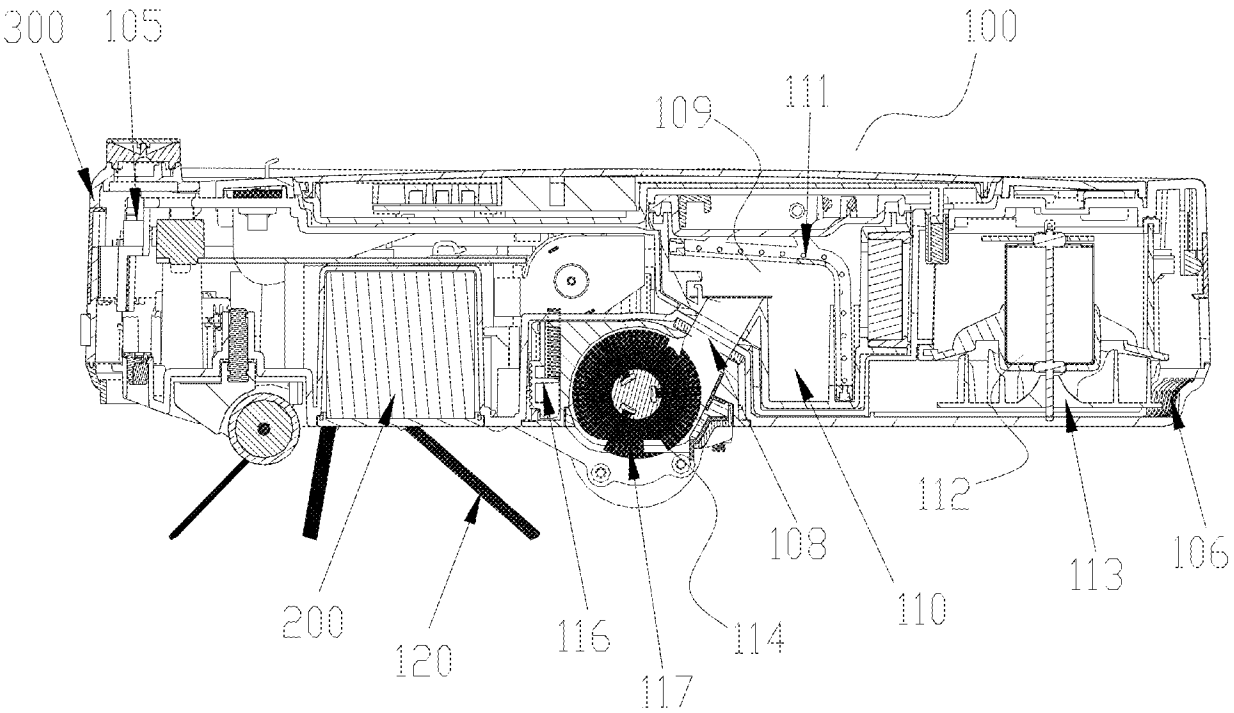
FIG. 1 is a side cross-sectional view of a smart robotic cleaner with multiple working modes mounting a rolling brush assembly, according to embodiments in the present disclosure.
Figure 2:
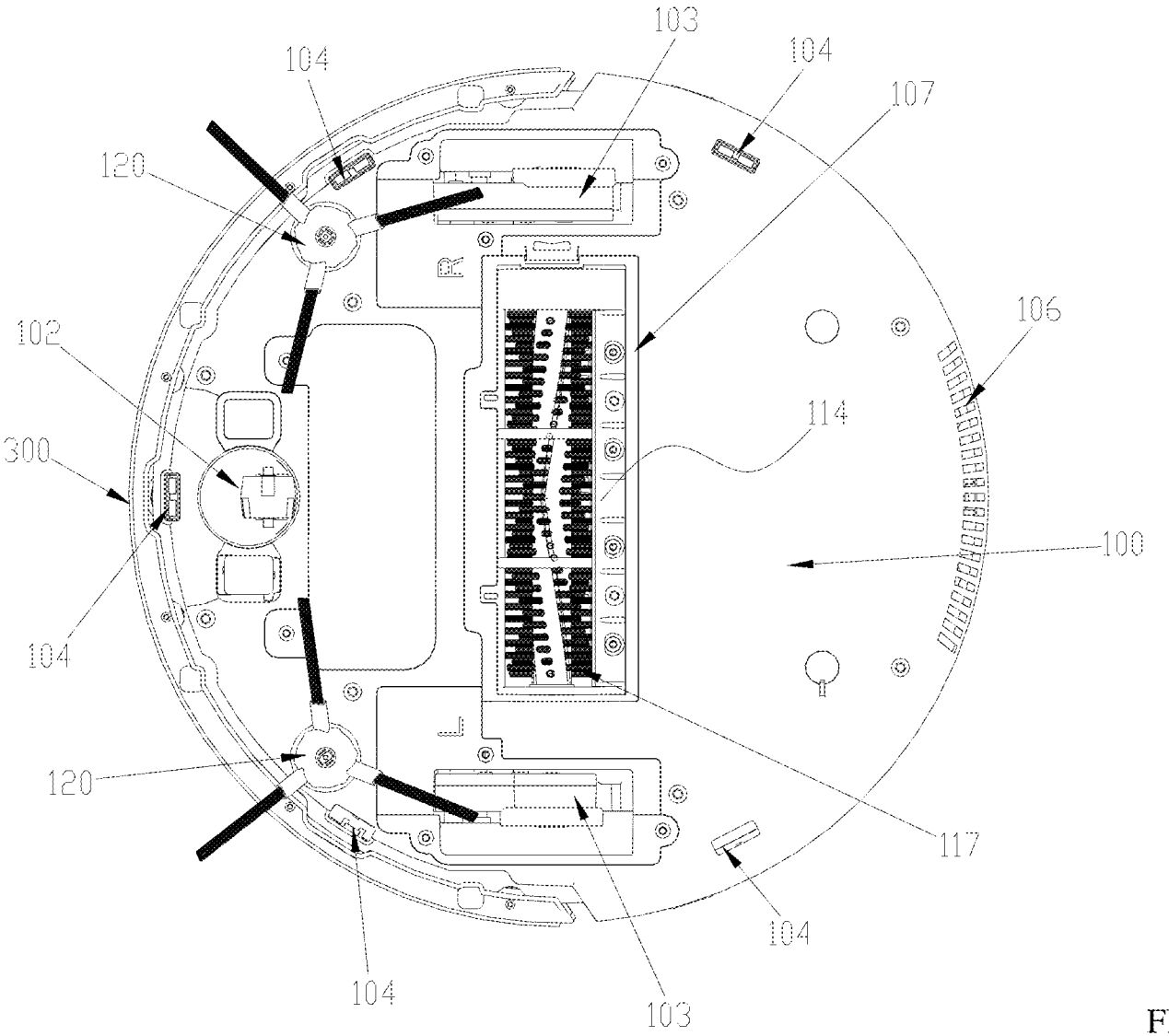
FIG. 2 is a bottom view of a smart robotic cleaner with multiple working modes mounting a rolling brush assembly, according to embodiments in the present disclosure.
Figure 3:
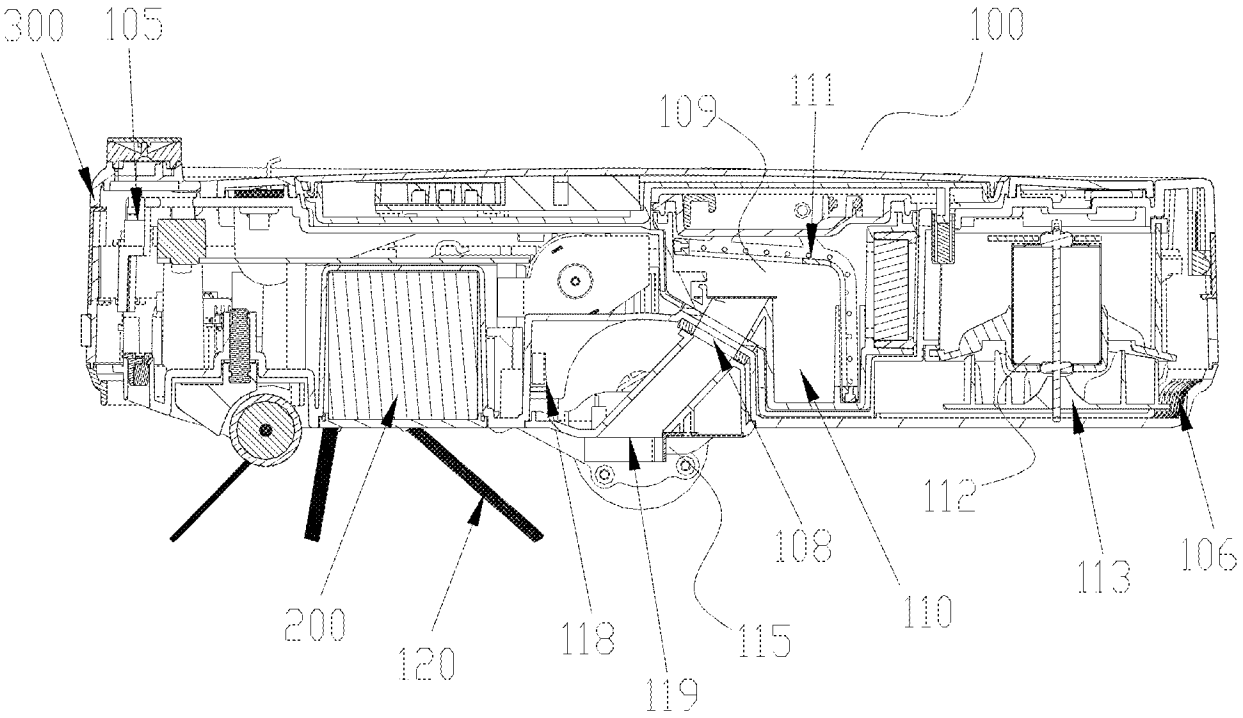
FIG. 3 is a side cross-sectional view of a smart robotic cleaner with multiple working modes mounting a suction inlet assembly, according to embodiments in the present disclosure.
Figure 4:
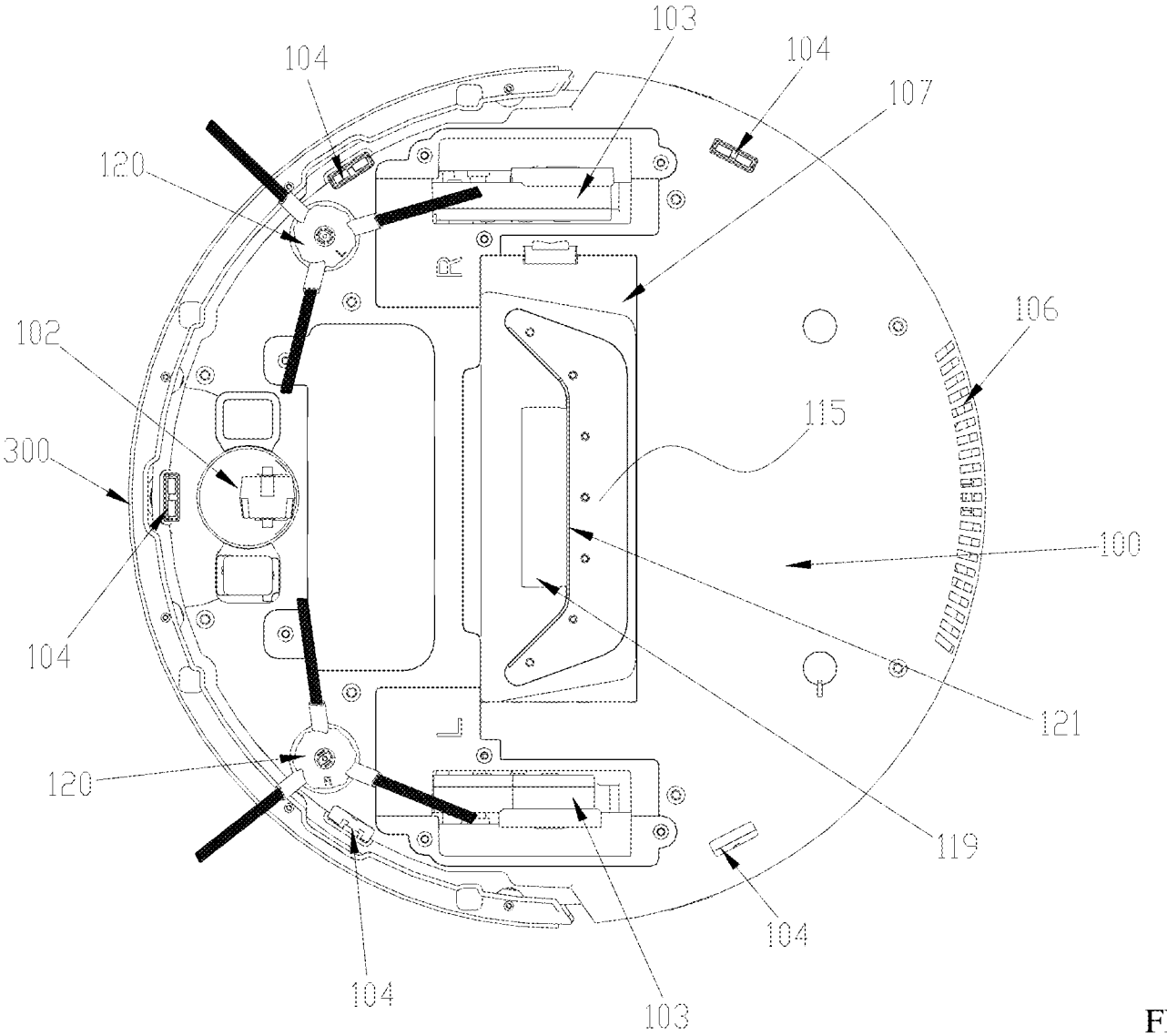
FIG. 4 is a bottom view of a smart robotic cleaner with multiple working modes mounting a suction inlet assembly, according to embodiments in the present disclosure.

The present disclosure is explained in greater details below in conjunction with detailed implementations. The figures are just for exemplary illustration. They are schematic diagrams, rather than physical object diagrams, and cannot be construed as limiting the present disclosure; to illustrate the embodiments of the present disclosure better, the drawings have some components omitted, zoomed in or out, and do not represent the actual size of the product; to a person skilled in the art, it is understandable that some well-known structures in the drawings and descriptions thereof may be omitted.

A method for providing multiple ways of cleaning on a smart robotic cleaner: providing two cleaning modes of rolling brush sweeping and vacuuming on a smart robotic cleaner; and an electronic control unit of the smart robotic cleaner switches the cleaning modes automatically according to the different cleaning devices replaced on the smart robotic cleaner. That is, as long as a user replaces two different cleaning devices on the body of a smart robotic cleaner, the electronic control unit in the body may control the smart robotic cleaner to switch between the cleaning modes automatically; thus, the two cleaning modes may be switched based on a user's need, achieving a multi-purpose machine. There are more ways of cleaning, and the applicable scope is more extensive.

In particular, when a rolling brush assembly is installed on the smart robotic cleaner, the smart robotic cleaner is switched to a cleaning mode of rolling brush sweeping by the electronic control unit; after the smart robotic cleaner is started, a rolling brush of the rolling brush assembly rotates and sweeps garbage into the smart robotic cleaner; dust is drawn in a dust box of the smart robotic cleaner through the suction of a centrifugal fan. Therefore, the smart robotic cleaner could sweep floors efficiently under the co-work of a rolling brush and a centrifugal fan.

When a suction inlet assembly is mounted on the smart robotic cleaner, the smart robotic cleaner is switched to a cleaning mode of vacuuming by the electronic control unit; after the smart robotic cleaner is started, the centrifugal fan rotates at a high speed, and a high speed airflow generated thereof causes pressure difference between the inside of an air duct system and the external atmospheric pressure; certain suction is generated in the vicinity of a suction inlet of the suction inlet assembly, and garbage is drawn into a dust box of the smart robotic cleaner. Therefore, the suction inlet may vacuum efficiently under the high speed working of the centrifugal fan.

According to the above methods, the present embodiment comprises an apparatus for providing multiple ways of cleaning on a smart robotic cleaner. As shown in FIGS. 1-4, a smart robotic cleaner with multiple working modes, comprises a body 100, and an electronic control unit is provided in the body 100 (not shown). The electronic control unit comprises a battery 200, a PCB board (not shown) and several motors (not shown). A universal wheel 102 and driving wheels 103 are mounted on the front side and the left and right sides of the bottom of the body 100, respectively. The universal wheel 102 and driving wheels 103 are connected to the output signal of the electronic control unit, respectively. Sensing probes 104 are circumferentially distributed on the bottom of the body 100. A bumper assembly 300 is mounted on the front side of the body 100, and sensors 105 are provided in the bumper assembly 300. The sensing probes 104 and the sensor 105 are connected to the input signal of the electronic control unit, respectively. When the bumper assembly 300 encounters an obstacle during the advancement of the body 100, the sensor 105 may change the steering of the universal wheel 102 through the electronic control unit after being triggered by collision; when the sensing probe 104 at the bottom detects that there is cliff below during the advancement of the body 100, i.e. long distance from the ground, the sensing probe 104 may change the steering of the universal wheel 102 and driving wheels 103 through the electronic control unit.

An air outlet 106 is provided at the lower portion of the rear side of the body, and a mounting position 107 is formed on the bottom of the body 100. An air inlet 108 is provided at the mounting position 107. A dust box assembly 109 is provided inside the body 100, and the dust box assembly 109 comprises a dust box 110 and a filter 111. The dust box 110 is located on one side of the air inlet 108 which connects the dust box 110 with the outside. A ventilation device 112 is provided at the rear of the body 100, and the ventilation device 112 comprises a holder (not shown in the figures) and a centrifugal fan 113. The rotation shaft of the centrifugal fan 113 is mounted in the body 100 vertically. One side of the centrifugal fan 113 corresponds to an air outlet 106. The body 100 comprises a lid and a chassis (not shown in the figures), and the body 100 further comprises components, such as a holder for the filter, a cover of the dust box, and a hood for motors (not shown in the figures) inside. There is room left between respective components and the lid or chassis, and all parts of the room interconnect with each other and form an air duct (not shown) in the body 100, which extends forward to the air inlet 108 and back to the air outlet 106. The rotation shaft of the centrifugal fan 113 locates correspondingly in the air duct.

Figure 5:
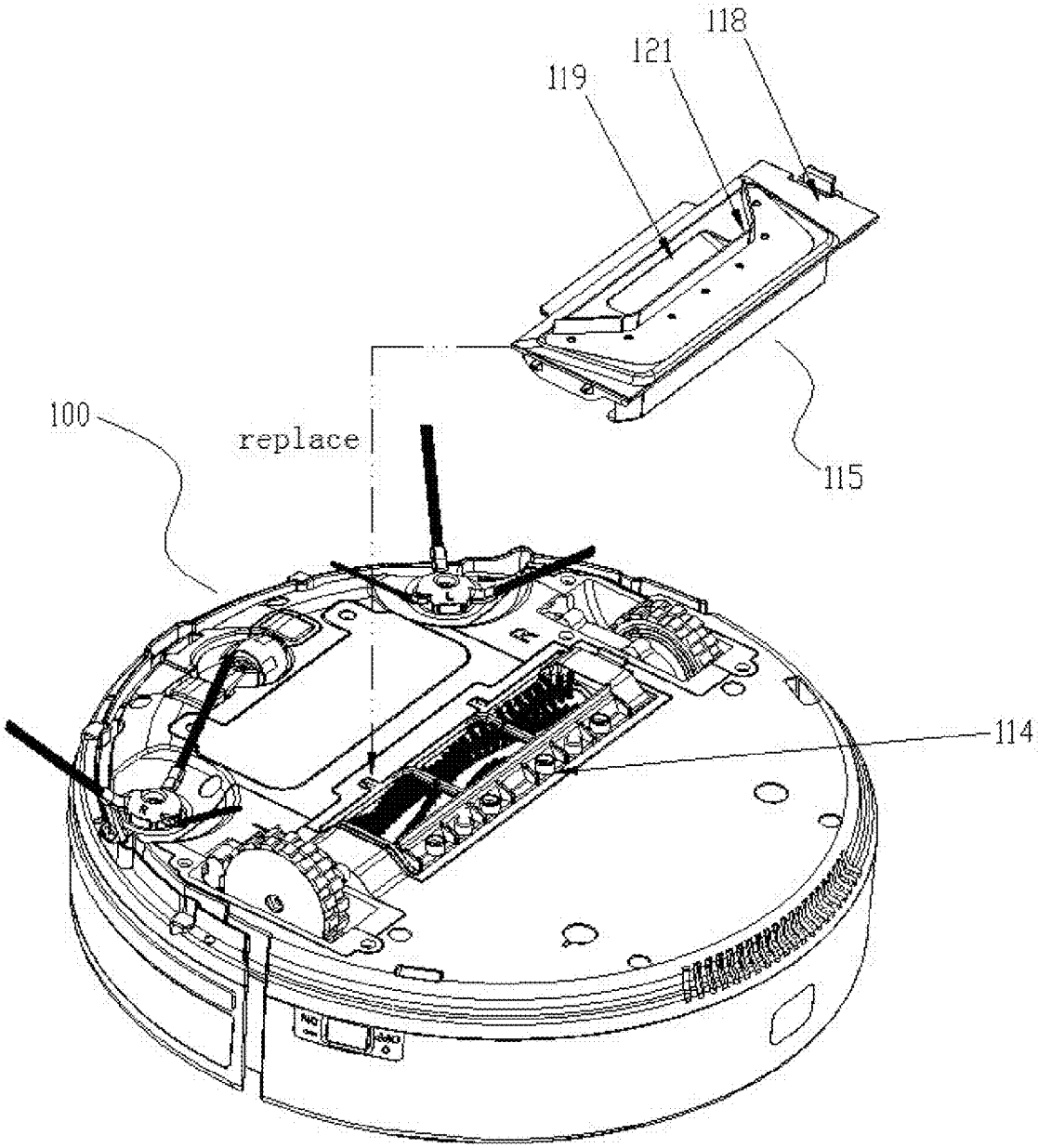
FIG. 5 is a schematic diagram of the overall structure of a smart robotic cleaner with multiple working modes mounting a rolling brush assembly, according to embodiments in the present disclosure.
Figure 6:
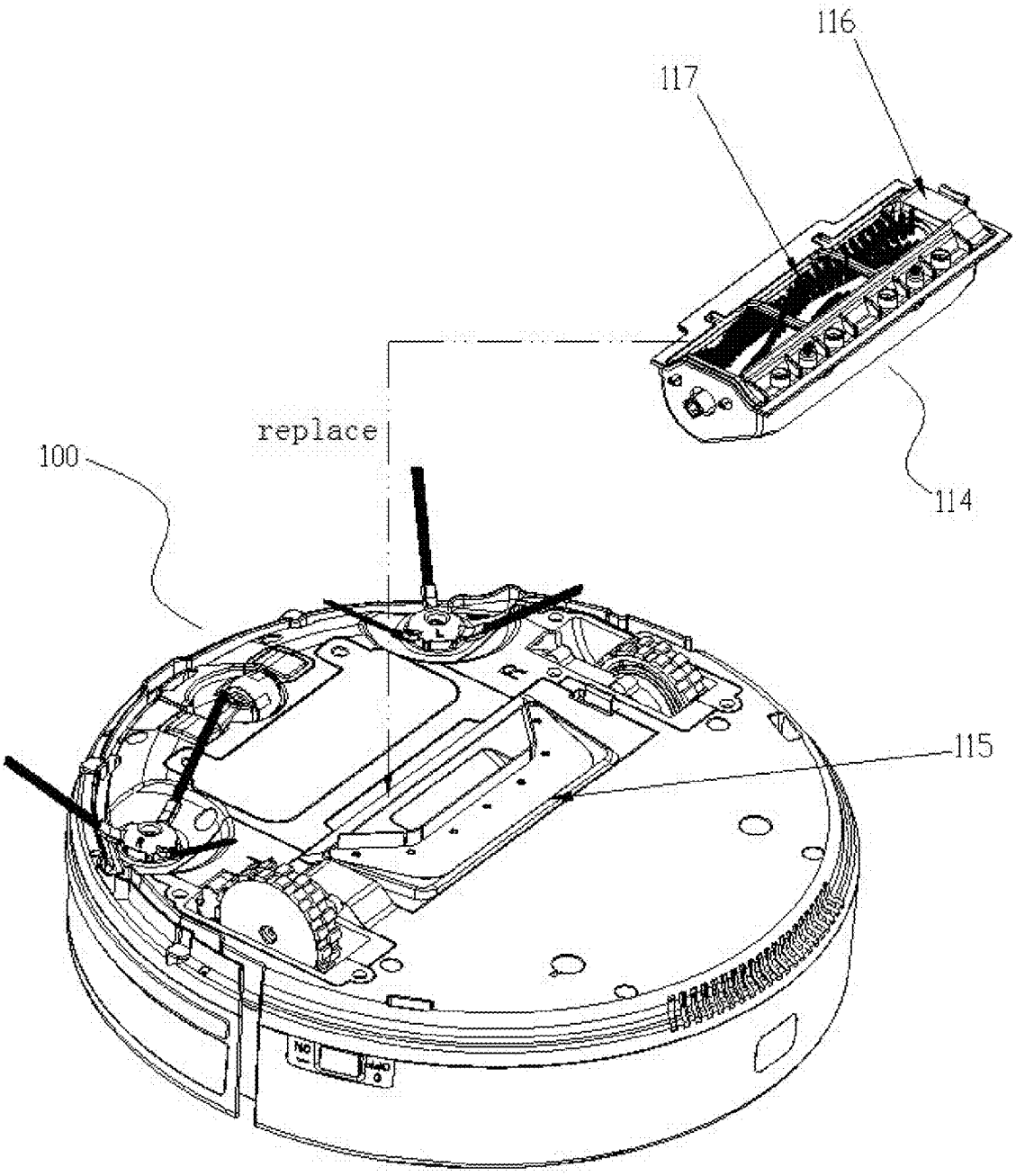
FIG. 6 is a schematic diagram of the overall structure of a smart robotic cleaner with multiple working modes mounting a suction inlet assembly, according to embodiments in the present disclosure.

In conjunction with FIGS. 5 and 6, a rolling brush assembly 114 and a suction inlet assembly 115 could be detachably mounted on the mounting position 107. The rolling brush assembly 114 and the suction inlet assembly 115 can be replaced with each other at the mounting position. When the rolling brush assembly 114 is mounted on the mounting position 107, the robotic cleaner enters a cleaning mode of rolling brush sweeping, and the rolling brush assembly works. When the suction inlet assembly 115 is mounted on the mounting position 107, the robotic cleaner enters a cleaning mode of vacuuming, and the suction inlet assembly works. In particular, the rolling brush assembly 114 comprises a brush holder 116 detachably mounted on the mounting position 107 and a rolling brush 117 pivotally connected to the brush holder 116. The pivot axis of the rolling brush 117 is set horizontally. The suction inlet assembly 115 comprises a suction inlet holder 118 detachably mounted on the mounting position 107 and a suction inlet 119 formed on the suction inlet holder 118. When the brush holder 116 is mounted on the mounting position 107, the air inlet 108 corresponds to the rolling brush 117. When the suction inlet holder 118 is mounted on the mounting position 107, the air inlet 108 docks with the suction inlet 119.

In addition, the rotating speed of the centrifugal fan 113 may vary depending on the switching of the cleaning modes of the body. Therefore, the speed of the centrifugal fan could be changed depending on the demands of different cleaning modes, in order to control the fan speed reasonably and save energy.

Sweeping brushes 120 are movably mounted on both sides of the body 100 at the bottom. Sweeping brushes 120 are pivotally connected to the body 100, and the pivot axis is set vertically. The pivot axes of sweeping brushes 120 are connected to driving motors (not shown) within the body 100, respectively. The rotation radius of a sweeping brush 120 is close to the mounting position 107, and could sweep garbage to the position of a rolling brush 117 or a suction inlet 119, so that the garbage could go into the air inlet 108 through the rolling brush 117 or the suction inlet 119.

When the smart robotic cleaner is powered-on, the centrifugal fan 113, the sweeping brush 120, driving wheels 103 and the universal wheel 102 starts to run under control of the electronic control unit; the sensor 105 and sensing probes 104 also start to work, and the electronic control unit controls the robotic cleaner to act properly according to sensed signals. The centrifugal fan 113 keeps drawing air out of the body after starting, which makes the air duct of the body 100 enter the state of negative pressure. The air outside could thus come into the body 100 through the air inlet 108 and flow through the dust box 110 along the air duct of the body 100; finally, the air is drawn to the air outlet 106 by the centrifugal fan 113 and discharged out of the body 100, which forms an airflow in the body 100. When the rolling brush assembly 114 is mounted on the body, waste such as dust and garbage could be drawn into the air inlet 108 along with the airflow by the time the rolling brush 117 sweeps the floor, and got sucked into the dust box 110 along the air duct. Garbage and dust of certain volume are collected in the dust box 110 finally after being filtered by the filter 111. When the suction inlet assembly 115 is mounted on the body 100, waste such as dust and garbage located below the suction inlet 119 could go to the air inlet 108 through the suction inlet 119 along with the airflow as the body 100 moves, and go into the dust box 110 along the air duct and are collected in the dust box 110 after being filtered by the filter 111. Meanwhile, with the assistance of the sweeping brush 120, garbage and dust near the body 100 and the air inlet 108 could be swept directly to the position of the rolling brush 117 or the suction inlet 119, which expands the range of cleaning. In addition, as the sweeping brush 120 keeps sweeping the garbage and dust toward the rolling brush 117 or the suction inlet 119, the garbage and dust may accumulate at the air inlet 108 quickly. The cross section between the air inlet 108 and the air outside becomes increasingly smaller as the garbage and dust accumulate, which makes the negative pressure of the air duct in the body 100 rise within a period of time and increases the suction at the air inlet 108 gradually. Therefore, it is possible to increase the driving force of the airflow within the air duct efficiently and improve the vacuuming performance of the robotic cleaner significantly.

Since the rolling brush assembly 114 and the suction inlet assembly 115 may be detachably mounted on the mounting position 107, the rolling brush assembly 114 and the suction inlet assembly 115 could be replaced with each other at the mounting position 107. As such, users may mount a rolling brush assembly 114 or a suction inlet assembly 115 on the smart robotic cleaner according to the actual conditions during the process of cleaning floors, so that the setting of two cleaning modes of rolling brush sweeping and vacuuming could be implemented on the smart robotic cleaner, achieving a multi-purpose machine.

Figure 7:
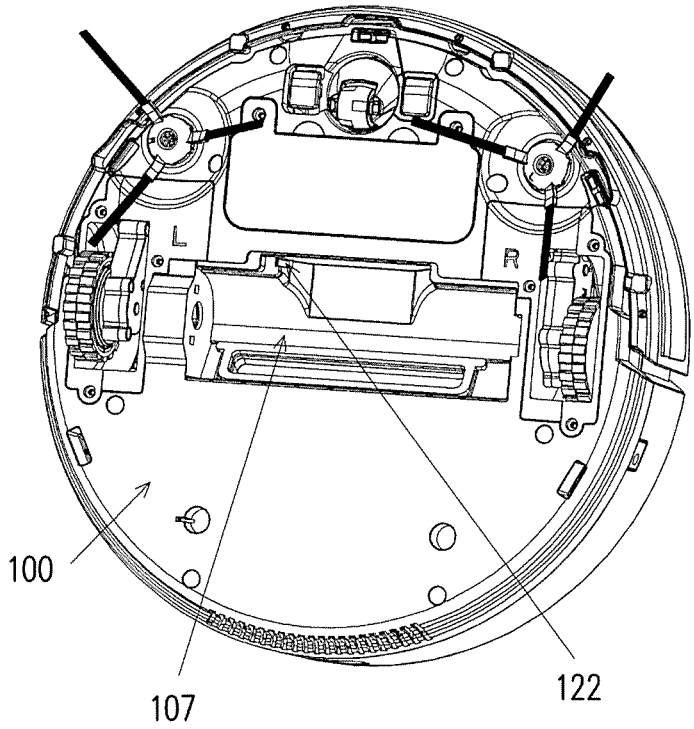
FIG. 7 is a schematic diagram of a mounting position of a smart robotic cleaner with multiple working modes, according to embodiments in the present disclosure.

In conjunction with FIG. 7, a switch 122 electrically connected to the electronic control unit is mounted on the mounting position 107. When the rolling brush assembly 114 is mounted on the mounting position 107, the rolling brush assembly 114 could abut and enable the switch 122 in order that the electronic control unit controls the body 100 to enter a cleaning mode of rolling brush sweeping and drives the rolling brush 117. In particular, when the rolling brush assembly 114 is mounted on the mounting position 107 of the body 100, the rolling brush 117 is connected to a motor in the body 100. After the rolling brush assembly 114 enables the switch 122, the switch 122 issues a trigger signal to the electronic control unit, and the electronic control unit could start the motor connected to the rolling brush 117 in order to drive the rolling brush 117. When the rolling brush assembly 114 is removed from the mounting position 107 and the suction inlet assembly 115 is mounted, the switch 122 is disconnected. The motor connected to the rolling brush 117 will not be started. Now the suction inlet assembly 115 is mounted on the mounting position 107, and the electronic control unit may control the body 100 to enter a cleaning mode of vacuuming and start working Therefore, the robotic cleaner is able to switch between the two cleaning modes according to the actual conditions.

As further complement and improvement to the present embodiment, a semi-closed baffle 121 is provided at the bottom of the suction inlet holder 118, and the suction inlet 119 is located within the semi-closed range of the semi-closed baffle 121. The sweeping brush 120 may sweep the garbage into the semi-closed range of the semi-closed baffle 121 as it rotates. As a result, with the block of the semi-closed baffle 121, waste such as garbage and dust could accumulate more at the suction inlet 119, and the cross-section between the suction inlet 119 and the air outside becomes increasingly smaller as the garbage and dust accumulate, which makes the negative pressure of the air duct in the body 100 rise within a period of time and further makes the suction at the suction inlet 119 become gradually increasing. Therefore, it is possible to increase the driving force of the airflow within the air duct efficiently and improve vacuuming performance of the robotic cleaner significantly.

As further complement and improvement to the present embodiment, the filter 111 in the dust box assembly 109 comprises a coarse filter and a fine filter (not shown in the figures). The airflow in the air duct flows through the coarse filter and the fine filter in turn, and thus may separate the waste such as dust of different volume and collect them in the dust box 110 respectively, which facilitates the separation of the garbage later.

As further complement and improvement to the present embodiment, the air duct in the body 100 passes through all the motors in the body 100, and thus the airflow in the air duct may flow through the motors and cool the motors effectively which dissipate heat.

The above embodiments of the present disclosure are merely to illustrate the disclosure clearly by way of examples, and are not limiting the embodiments of the disclosure. To a person skilled in the art, change or variation in other different forms may be made based on the above description, without the need of exhausting all the embodiments. Any modification, equivalence and improvement made within the spirit and principle of the present disclosure should be included within the scope of protection of the disclosure.

The invention claimed is:

1. A smart robotic cleaner kit for providing multiple modes of cleaning, the smart robotic cleaner kit comprising:

(a) a smart robotic cleaner body, the smart robotic cleaner body being able to move on a floor, a driving motor and an electronic control unit provided in the smart robotic cleaner body;

an air inlet, an air outlet, a dust box assembly, a filter, and a ventilation device being provided in the body;

the ventilation device configured to create a suction air flow through air inlet, then through the dust box assembly, then through the filter, and then into the ventilation device;

wherein:

a mounting position is provided at the bottom of the smart robotic cleaner body adjacent the air inlet;

(b) a rolling brush assembly, configured to interchangeably mount to the mounting position of the smart robotic cleaner in fluid communication with the suction airflow, the rolling brush assembly comprising at least one pivotally mounted sweeping brush;

(c) a suction inlet assembly, configured to interchangeably mount to the mounting position of the smart robotic cleaner in fluid communication with the suction airflow, the suction inlet assembly configured without a pivotally mounted brush, the suction inlet assembly comprising a suction inlet:

wherein the electronic control unit of the smart robotic cleaner body automatically detects when the rolling brush assembly is attached to the mounting position on the smart robotic cleaner and switches to a first cleaning mode specific to the rolling brush assembly, the first cleaning mode including at least energizing the driving motor to rotate the at least one pivotally mounted sweeping brush;

wherein the electronic control unit of the smart robotic cleaner body automatically detects when the suction inlet assembly is attached to the mounting position on the smart robotic cleaner and switching to a second cleaning mode that is different from the first cleaning mode and specific to the suction inlet assembly, the second cleaning mode including at least de-energizing the driving motor.

2. The smart robotic cleaner kit of claim 1, wherein:

a switch electrically connected to the electronic control unit is provided on the mounting position, the switch being configured to provide a first signal to the electronic control unit when the rolling brush assembly is mounted to the mounting position, the switch being configured to provide a second signal to the electronic control unit when the suction inlet assembly is mounted to the mounting position, the first signal and second signal being different;

wherein the electronic control unit is configured to switch to the first cleaning mode when the first signal is provided, and wherein the electronics control unit is configured to switch to the second cleaning mode when the second signal is provided.

3. The smart robotic cleaner kit of claim 1, wherein:

the rolling brush assembly comprises a rolling brush holder and the at least one pivotally mounted sweeping brush pivotally connected to the rolling brush holder;

wherein during operation of the first cleaning mode, the rolling brush assembly is mounted to the smart robotic cleaner body, the pivot axis of the at least one pivotally mounted sweeping brush is set horizontally, the electronic control unit energizes the driving motor to rotate the at least one pivotally mounted sweeping brush and sweep dust or garbage into the suction airflow and into the dust box assembly of the smart robotic cleaner body.

4. The smart robotic cleaner kit of claim 1, wherein:

the suction inlet assembly comprises a suction inlet holder and the suction inlet formed on the suction inlet holder;

wherein during operation of the second cleaning mode, the suction inlet assembly is mounted to the smart robotic cleaner body, the electronic control unit de-energizes the driving motor and the suction inlet directs dust or garbage into the suction airflow and into the dust box assembly of the smart robotic cleaner body.

5. The smart robotic cleaner kit of claim 1, wherein:

the filter of the dust box assembly in the body comprises a coarse filter and a fine filter; and the suction airflow flows through the coarse filter and the fine filter in turn.

6. The smart robotic cleaner kit of claim 1, wherein:

the ventilation device comprises a centrifugal fan, and the electronic control unit is capable of changing the rotating speed of the centrifugal fan between the first and second cleaning modes.

7. A method for providing multiple modes of cleaning on a smart robotic cleaner, the method comprising:

providing a smart robotic cleaner comprising an electronic control unit, a driving motor, a mounting position, an air inlet, a dust box assembly, and a filter, the smart robotic cleaner configured to create a suction airflow through the air inlet, then through the dust box assembly, and then through the filter;

providing a rolling brush sweeping assembly, configured to detachably mount to the mounting position, the rolling brush sweeping assembly comprising at least one pivotally mounted sweeping brush;

providing a suction inlet assembly, configured to detachably mount to the mounting position, the suction inlet assembly configured without a pivotally mounted brush, the suction inlet assembly comprising a suction inlet;

attaching one of the rolling brush sweeping assembly or the suction inlet assembly to the mounting position on the smart robotic cleaner to be in fluid communication with the suction airflow;

automatically detecting, with the electronic control unit of the smart robotic cleaner, that the one of the rolling brush sweeping assembly or the suction inlet assembly is attached to the mounting position on the smart robotic cleaner and switching to a first cleaning mode specific to the one of the rolling brush sweeping assembly or the suction inlet assembly that is attached;

removing the one of the rolling brush sweeping assembly or the suction inlet assembly from the mounting position on the smart robotic cleaner;

attaching an other of the one of the rolling brush sweeping assembly or the suction inlet assembly to the mounting position on the smart robotic cleaner to be in fluid communication with the suction airflow;

automatically detecting, with the electronic control unit of the smart robotic cleaner, that the other of the one of the rolling brush sweeping assembly or the suction inlet assembly is attached to the mounting position on the smart robotic cleaner and switching to a second cleaning mode that is different from the first cleaning mode and specific to the other of the one of the rolling brush sweeping assembly or the suction inlet assembly that is attached;

wherein the electronic control unit energizes the driving motor to rotate the at least one pivotally mounted sweeping brush when the rolling brush sweeping assembly is attached to the mounting position on the smart robotic cleaner; and wherein the electronic control unit de-energizes the driving motor when the suction inlet assembly is attached to the mounting position on the smart robotic cleaner.

8. The method of claim 7, wherein:

when the rolling brush sweeping assembly is mounted on the smart robotic cleaner, the smart robotic cleaner automatically detects the rolling brush sweeping assembly;

after the smart robotic cleaner is started, a centrifugal fan inside the smart robotic cleaner creates the suction airflow directed through the rolling brush sweeping assembly, then through the air inlet, then through the dust box assembly, then through the filter, and then into the centrifugal fan, and the at least one pivotally mounted sweeping brush of the rolling brush sweeping assembly rotates and sweeps dust or garbage into the smart robotic cleaner; and the dust or the garbage is collected in the dust box assembly of the smart robotic cleaner.

9. The method of claim 7, wherein:

when the suction inlet assembly is mounted on the smart robotic cleaner, the smart robotic cleaner automatically detects the suction inlet assembly;

after the smart robotic cleaner is started, a centrifugal fan inside the smart robotic cleaner rotates at a high speed to create the suction airflow directed through the suction inlet assembly, then through the air inlet, then through the dust box assembly, then through the filter, and then into the centrifugal fan, and a suction inlet of the suction inlet assembly is configured to direct dust or garbage into the suction airflow of the smart robotic cleaner; and the dust or the garbage is collected in the dust box assembly of the smart robotic cleaner.

* * * * *